US008505352B2

(12) United States Patent
Flehmig et al.

(10) Patent No.: US 8,505,352 B2
(45) Date of Patent: Aug. 13, 2013

(54) METHOD FOR PRODUCING HOLLOW PROFILES HAVING A LONGITUDINAL FLANGE

(71) Applicants: Thomas Flehmig, Ratingen (DE); Michael Brüggenbrock, Rosendahl (DE); Jörg Gorschlüter, Hamm (DE)

(72) Inventors: Thomas Flehmig, Ratingen (DE); Michael Brüggenbrock, Rosendahl (DE); Jörg Gorschlüter, Hamm (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 13/676,851

(22) Filed: Nov. 14, 2012

(65) Prior Publication Data

US 2013/0091919 A1 Apr. 18, 2013

Related U.S. Application Data

(63) Continuation of application No. PCT/EP2011/057100, filed on May 4, 2011.

(30) Foreign Application Priority Data

May 14, 2010 (DE) ..... 10 2010 016 960

(51) Int. Cl.

| | |
|---|---|
| ***B21D 22/00*** | (2006.01) |
| ***B21C 37/06*** | (2006.01) |
| *B21C 37/08* | (2006.01) |
| *B21D 51/28* | (2006.01) |

(52) U.S. Cl.
USPC ..... 72/352; 72/360; 72/379.2; 72/475; 72/51; 72/367.1; 72/368

(58) Field of Classification Search
USPC ..... 72/347, 348, 352, 358–360, 379.2, 72/379.6, 380, 386, 389.1, 414, 475, 48, 72/51, 367.1, 368, 381, 383, 394, 399, 403
See application file for complete search history.

(56) References Cited

U.S. PATENT DOCUMENTS 1,344,105 A 6/1920 Vance
5,070,717 A * 12/1991 Boyd et al. ..... 72/55

(Continued)

FOREIGN PATENT DOCUMENTS

DE 4328441 A1 3/1995
DE 102005011764 A 9/2006

(Continued)

*Primary Examiner* — Dana Ross
*Assistant Examiner* — Pradeep C Battula
(74) *Attorney, Agent, or Firm* — Reinhart Boerner Van Deuren P.C.

(57) ABSTRACT

The invention relates to a method for producing hollow profile-members having a longitudinal flange, wherein a plate which is arranged between the stamp and the first die being preshaped by introducing a stamp into a first die to form an U-shaped profile-member having a first member and a second member, and wherein the U-shaped profile-member being shaped with a second die to form an O-shaped profile-member having a longitudinal flange. In one aspect, the plate is preshaped to form the U-shaped profile-member, a longitudinal flange member portion is shaped in at least the first member and the longitudinal flange member portion is constructed during the shaping of the U-shaped profile-member to form an O-shaped profile-member substantially in a shape-retaining manner to form a portion of the longitudinal flange.

9 Claims, 7 Drawing Sheets

(56) References Cited

U.S. PATENT DOCUMENTS

| | | | | |
|---|---|---|---|---|
| 5,349,839 | A * | 9/1994 | Weykamp et al. | 72/296 |
| 6,467,146 | B1 * | 10/2002 | Herman | 72/56 |
| 7,082,795 | B2 * | 8/2006 | Ooyauchi et al. | 72/368 |
| 7,325,435 | B2 * | 2/2008 | Hamel et al. | 72/368 |
| 7,350,386 | B2 * | 4/2008 | Streubel | 72/368 |
| 2005/0126241 | A1 * | 6/2005 | Ooyauchi et al. | 72/51 |
| 2007/0131015 | A1 * | 6/2007 | Matsumura et al. | 72/368 |
| 2009/0272171 | A1 * | 11/2009 | Golovashchenko | 72/348 |

FOREIGN PATENT DOCUMENTS

| | | | |
|---|---|---|---|
| DE | 102008056273 | A1 | 9/2010 |
| EP | 1382518 | A1 | 1/2004 |
| GB | 1384 | | 0/0000 |

* cited by examiner

METHOD FOR PRODUCING HOLLOW PROFILES HAVING A LONGITUDINAL FLANGE

CROSS-REFERENCE TO RELATED PATENT APPLICATIONS

This patent application is a continuation of PCT/EP2011/057100, filed May 4, 2011, which claims priority to German Application No. 102010016960.9, filed May 14, 2010, the entire teachings and disclosure of which are incorporated herein by reference thereto.

FIELD OF THE INVENTION

The present invention relates to a method for producing hollow profile-members having a longitudinal flange, wherein a plate which is arranged between the stamp and the first die being preshaped by introducing a stamp into a first die to form an U-shaped profile-member having a first member and a second member, and wherein the U-shaped profile-member being shaped with a second die to form an O-shaped profile-member having a longitudinal flange, wherein the plate is preshaped to form the U-shaped profile-member, a longitudinal flange member portion is shaped in at least the first member and the longitudinal flange member portion is constructed during the shaping of the U-shaped profile-member to form an O-shaped profile-member substantially in a shape-retaining manner to form a portion of the longitudinal flange.

BACKGROUND OF THE INVENTION

A method for producing a hollow profile-member having a longitudinal flange is described, for example, in DE 10 2005 011 764 A1. In the known method, a profile-member which is U-shaped in cross-section and which has parallel members is produced in a first bending die. This U-shaped profile-member is subsequently shaped in a second bending die by means of an upper bending die to form a tubular member having a closed cross-section. In this instance, a flange which extends in a longitudinal direction is formed in at least one of the members. In the method known from DE 10 2005 011 764 A1, therefore, the U-shaped profile-member must be removed from the first bending die and be introduced into the second bending die in order to be able to be shaped to form an O-shaped profile-member.

Furthermore, methods for producing hollow profile-members having a longitudinal flange are, at which at least one longitudinal flange member portion is constructed during the shaping of the U-shaped profile-member to form an O-shaped profile-member substantially in a shape-retaining manner to form a portion of the longitudinal flange, are known from GB 1914 01384 A, DE 43 28 441 A1 and U.S. Pat. No. 1,344,105.

Hollow profile-members having a longitudinal flange are used in particular in vehicle construction as bodywork elements. The longitudinal flange serves, for example, to connect metal bodywork sheets. Increasingly high demands are made with respect to the dimensional accuracy of hollow profile-members. This applies in particular to the portions of the hollow profile-members with which the hollow profile-members are connected to other components. These demands are not always met by hollow profile-members which have a longitudinal flange and which are produced using the conventional method since, owing to the transport of the U-shaped profile-member from the first die to the second die, there is necessarily a degree of imprecision when not very complex and cost-intensive measures are taken. This applies in particular to curved hollow profile-members.

SUMMARY OF THE INVENTION

Based on the above-mentioned prior art, an object of the present invention is therefore to provide a process-reliable method for producing hollow profile-members having a longitudinal flange.

According to a first teaching of the invention, this object is achieved by a method for producing hollow profile-members having a longitudinal flange, wherein the longitudinal flange member portion is shaped at the beginning of the preshaping operation by means of a displaceable part-stamp of the stamp that is positioned so as to protrude in an introduction direction, and a displaceable side wall of the first die that is positioned so as to protrude counter to the introduction direction, the part-stamp and the side wall are each moved by the stamp being further introduced into the first die from the protruding position into an aligned position and the plate is preshaped to form the U-shaped profile-member.

Accordingly, already during the preshaping step in which a U-shaped profile-member is produced, at least a portion of the longitudinal flange is shaped according to the invention so that the dimensions of the one portion of the longitudinal flange can be precisely predetermined. The entire dimensional accuracy of the hollow profile-member can consequently be improved since, in the subsequent shaping steps, the high level of dimensional accuracy of the longitudinal flange does not explicitly have to be taken into account. The term "introduction" in the context of the invention means that the stamp and the first die move towards each other, that is to say, a relative movement between the stamp and die. This can be ensured either by a movement of the stamp or the first die but also by a movement of both the stamp and the first die.

Furthermore, the longitudinal flange member portion can be formed at the earliest possible time according to the invention. At this time, the position of the plate is precisely predetermined and the danger of distortion by means of a deep-drawing operation which is carried out at the same time is substantially reduced.

The method can further be developed in that a first die having at least a first displaceable side wall is used and the first side wall, when the U-shaped profile-member is shaped to form the O-shaped profile-member having a longitudinal flange, is displaced in the introduction direction by means of the second die. The side wall can laterally support the U-shaped profile-member in this manner during the shaping operation to form the O-shaped profile-member having a longitudinal flange so that the process reliability of the method can be improved.

In another embodiment of the method, there is used a second die which comprises a first part-die which is associated with the longitudinal flange member portion and at least one other part-die, and the U-shaped profile-member is shaped to form the O-shaped profile-member by the other part-die being lowered before the first part-die. Owing to the division of the second die, the process reliability when shaping the U-shaped profile-member to form the O-shaped profile-member can be further improved.

A next development makes provision for the U-shaped profile-member to be constructed to form an O-shaped profile-member having a doubled longitudinal flange. Doubled longitudinal flanges are distinguished by increased rigidity so that greater forces can be introduced into the hollow profile-member therewith.

The method can be further developed in that, before the U-shaped profile-member is shaped to form the O-shaped profile-member having a longitudinal flange, a support core, in particular a structured support core, is introduced into the U-shaped profile-member. With the support core, the U-shaped profile-member can be supported from the inner side during the shaping operation to form the O-shaped profile-member and buckling inwards can be prevented. The use of a structured support core also enables support when the U-shaped profile-member is intended to be shaped to form a curved hollow profile-member. In particular, a structured support core can also be pulled from the curved hollow profile-member in a non-destructive manner.

The method can also be further developed in that, by shaping the U-shaped profile-member to form the O-shaped profile-member having a longitudinal flange, an edge joint is formed and the O-shaped profile-member is closed along the edge joint at least partially in a materially engaging manner. When the laser welding is used to close the edge joint, the introduction of heat into the hollow profile-member can be minimised. A change of the material properties of the hollow profile-member by means of the closure can consequently be substantially prevented.

In another embodiment, the support core is pulled before or after the materially engaging closure. A pulling of the support core before the materially engaging closure may simplify the removal of the support core. For example, the risk of inadvertent materially engaging connection of the support core to the O-shaped profile-member is reduced. In addition, the edge joint can thus be made accessible from the inner side for closure. On the other hand, pulling of the support core enables greater dimensional accuracy of the hollow profile-member to be produced.

According to a next development, the hollow profile-member is produced from a monolithic plate, a Tailored Blank or a Patchwork Blank. A monolithic plate is understood to be one which comprises a single metal sheet of a specific thickness and a single material. Monolithic plates can be separated in a particularly cost-effective manner from cold or hot strips. "Tailored Blanks" refer to plates which are assembled from single metal sheets of differing thickness, strength and/or surface coating. On the one hand, at locations with a relatively high load, a thicker and/or a thinner but stronger material can thereby be used so that a lower weight can be achieved with higher loading capacity. On the other hand, thinner metal sheets can be used at the other locations. Tailored Blanks consequently enable a reduction in weight with the strength properties remaining the same. With "Patchwork Blanks", base plates are locally strengthened by individual additional reinforcement metal sheets being secured. Base plates and reinforcement metal sheets can subsequently be readily shaped together. The operationally complex and costly fitting of reinforcements to the subsequent component can consequently be dispensed with. As base plates for Patchwork Blanks, it is also in particular possible to consider Tailored Blanks, small local reinforcements being able to be provided with the reinforcement metal sheets so that, for the individual metal sheets of the "Tailored Blanks", a further reduced thickness or another material can be selected.

BRIEF DESCRIPTION OF THE DRAWINGS

The invention is intended to be explained in greater detail below together with embodiments with reference to drawings. In the drawings.

DETAILED DESCRIPTION OF THE INVENTION

Figure 1:
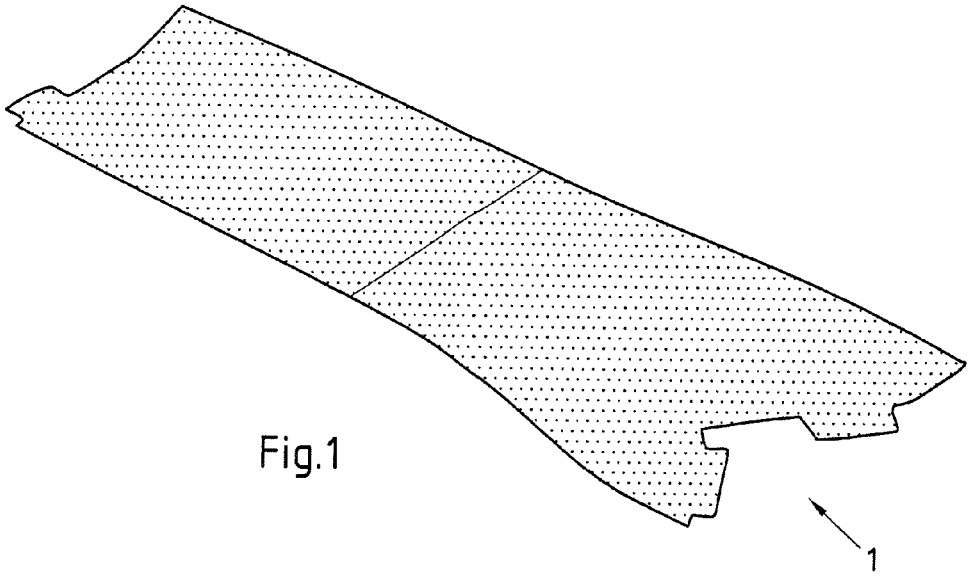
FIG. 1 shows a plate for producing a hollow profile-member in accordance with a first embodiment according to the invention.
Figure 2:
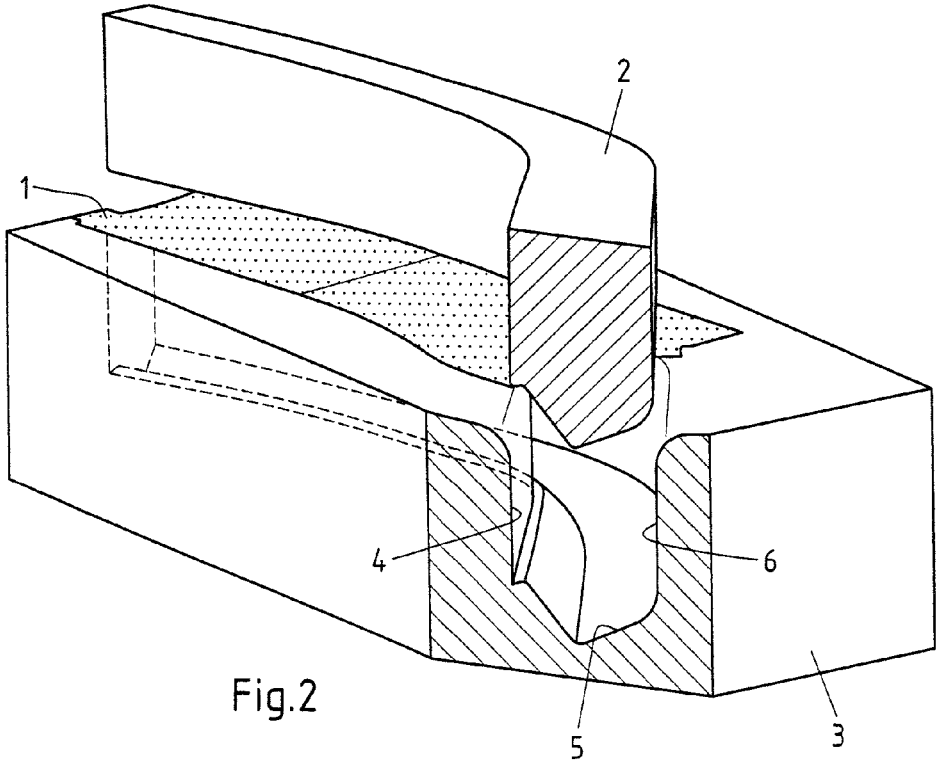
FIG. 2 shows the plate shown in FIG. 1 in an arrangement between a stamp and a first die.
Figure 3:
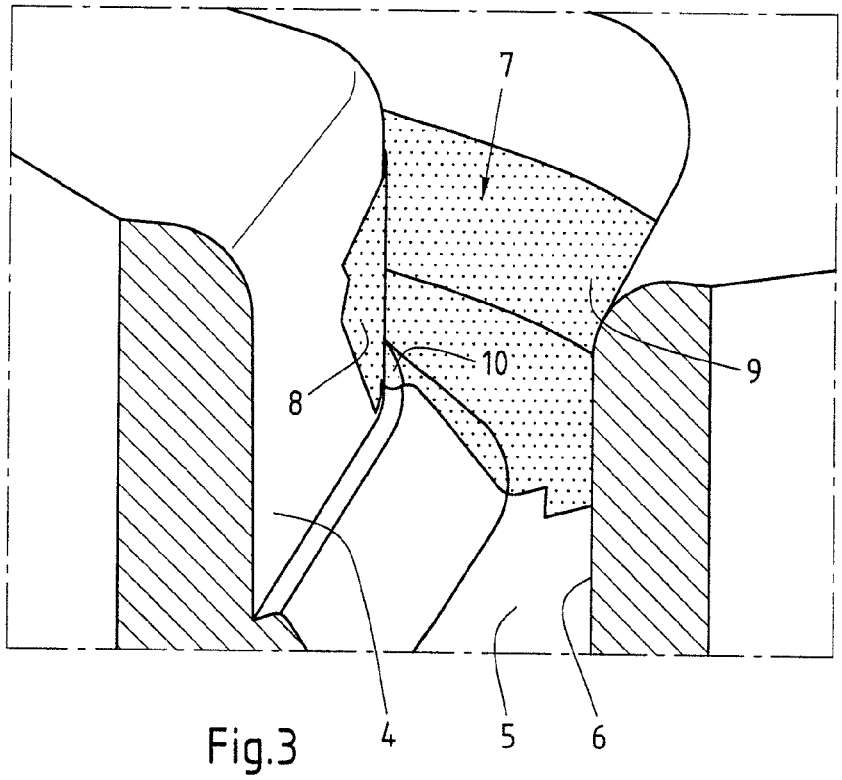
FIG. 3 is a cutout of the U-shaped profile-member preshaped from the plate shown in FIG. 1.

FIG. 1 shows a plate 1 which is specifically cut for the production of a hollow profile-member having a longitudinal flange. The blank of the plate 1 is dependent above all on the geometry of the completed hollow profile-member but also on the geometry of the longitudinal flange member portion 10 formed during the preshaping operation. As shown in FIG. 2, the cut plate 1 is arranged between a stamp 2 and a first die 3. The first die comprises two side walls 4 and 6 and a base element 5. By the stamp 2 being introduced into the first die 3, the plate 1 is preshaped to form a U-shaped profile-member 7. As can be seen in the cutout shown in FIG. 3, a first member 8 and a second member 9 and in the first member a longitudinal flange member portion 10 are shaped. A support core 11 is subsequently introduced into the U-shaped profile-member 7 which is formed in this manner.

Figure 4:
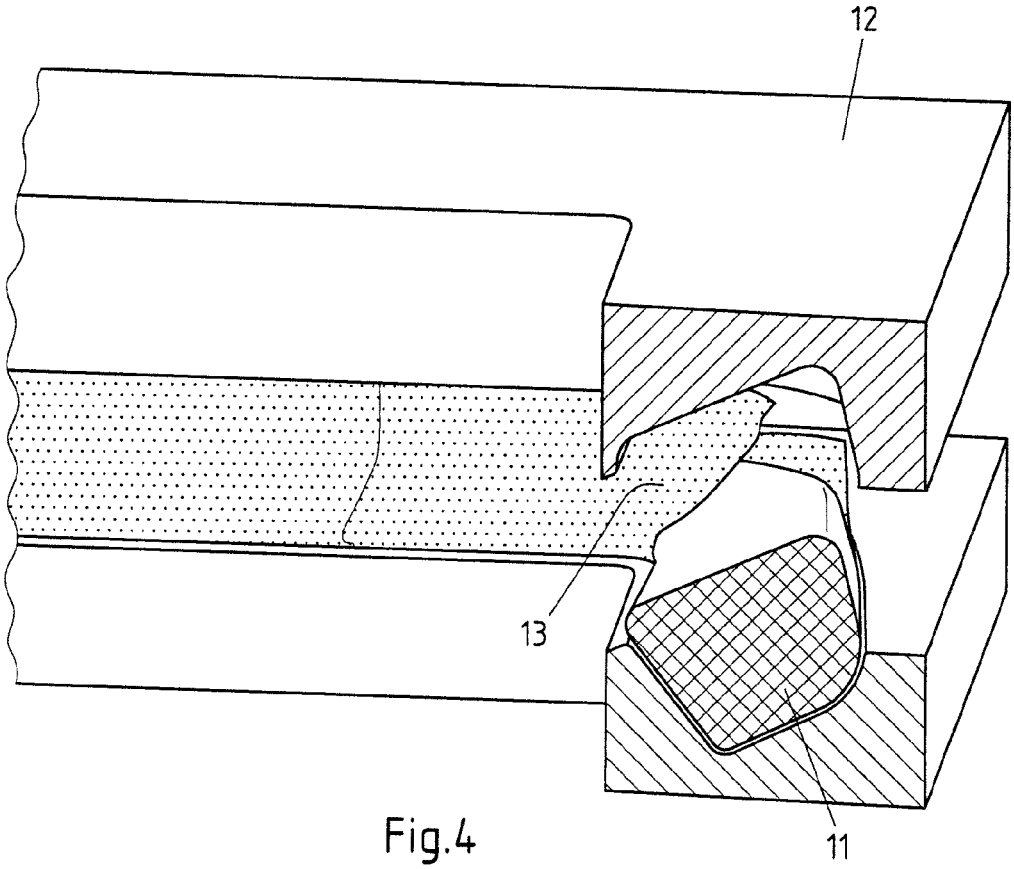
FIG. 4 shows an intermediate step when shaping the U-shaped profile-member partially shown in FIG. 3 to form an O-shaped profile-member.
Figure 5:
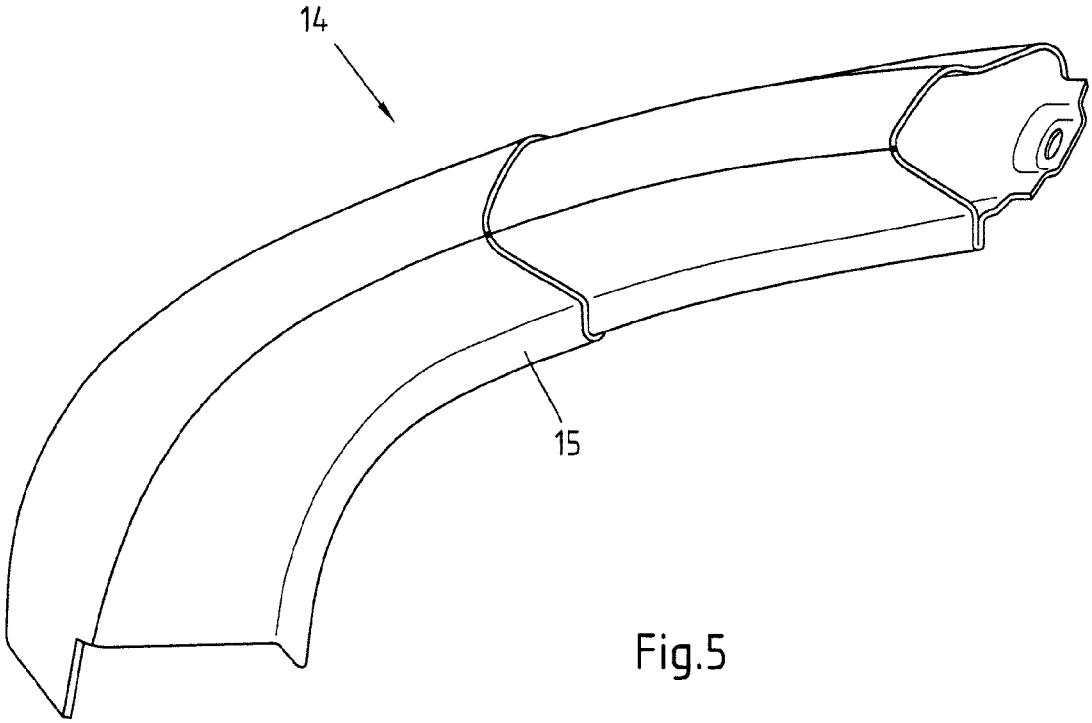
FIG. 5 shows a hollow profile-member having a longitudinal flange produced from the plate shown in FIG. 1.

In another method step, using a second die 12, the U-shaped profile-member is shaped to form an O-shaped profile-member having a longitudinal flange. FIG. 4 shows an U-shaped profile-member 13 which has not yet been shaped completely to form an O-shaped profile-member. For the purposes of illustration, the second die 12 used for the shaping operation is illustrated in a slightly raised position. Using the second die 12, the U-shaped profile-member 13 is shaped around the support core 11. The shape of the longitudinal flange member portion 10 is substantially retained. In the region of the longitudinal flange member portion 10, the material is doubled. By further lowering the second die 13, this portion of the U-shaped profile-member 13 is squeezed together so that an O-shaped profile-member with a doubled squeezing flange is formed. FIG. 5 shows the corresponding hollow profile-member 14 after the laser welding of the edge joint formed by the two members and the pulling of the support core 11. Along the curved hollow profile-member 14, there is formed a double longitudinal flange 15, by means of which other components can be fitted to the hollow profile-member 14.

Figure 6:
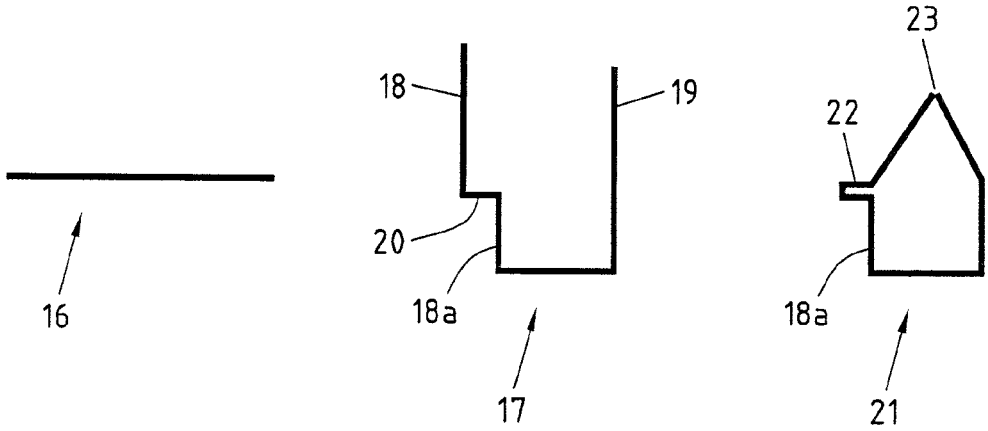
FIG. 6 is a schematic drawing to illustrate the production method shown in FIGS. 1 to 5.

FIG. 6 illustrates in highly simplified form the method steps which are carried out when the hollow profile-member is produced and in which the resulting cross-sectional shapes are shown in each case. Starting with a plate 16, an U-shaped profile-member 17 is first preshaped with a first member 18 and a second member 19. In this instance, a longitudinal flange member portion 20 is formed in the first member 18. Subsequently, the U-shaped profile-member 17 is shaped to form an O-shaped profile-member 21. In this instance, the longitudinal flange member portion 20 is doubled in a substantially shape-retaining manner and squeezed to form a longitudinal flange 22. The longitudinal flange 22 therefore has particularly good dimensional accuracy and, owing to the doubling, enormous strength. The longitudinal flange 22 can then be very effectively used for securing the hollow profile-member or for securing other components to the hollow profile-member. Finally, the edge joint 23 is at least partially closed by means of laser welding so that the hollow profile-member obtains a very high degree of rigidity. As described in the embodiment, a support core is preferably used. This is used with hollow profile-members which are to be shaped in a complex manner. With simple geometries, a support core can readily be dispensed with.

Figure 7:
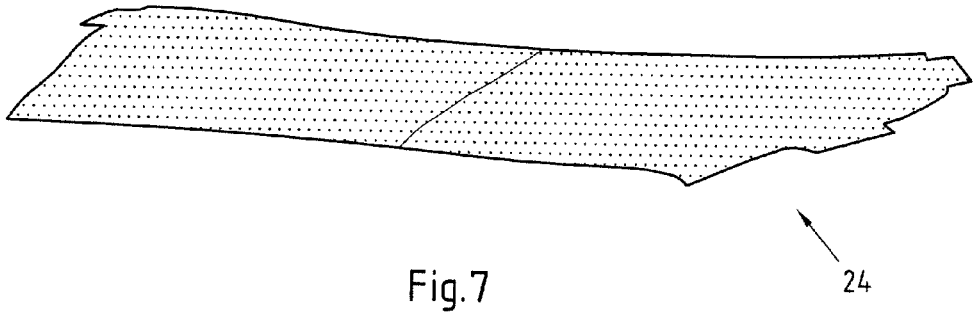
FIG. 7 shows a plate for producing a hollow profile-member according to a second embodiment according to the invention.
Figure 8:
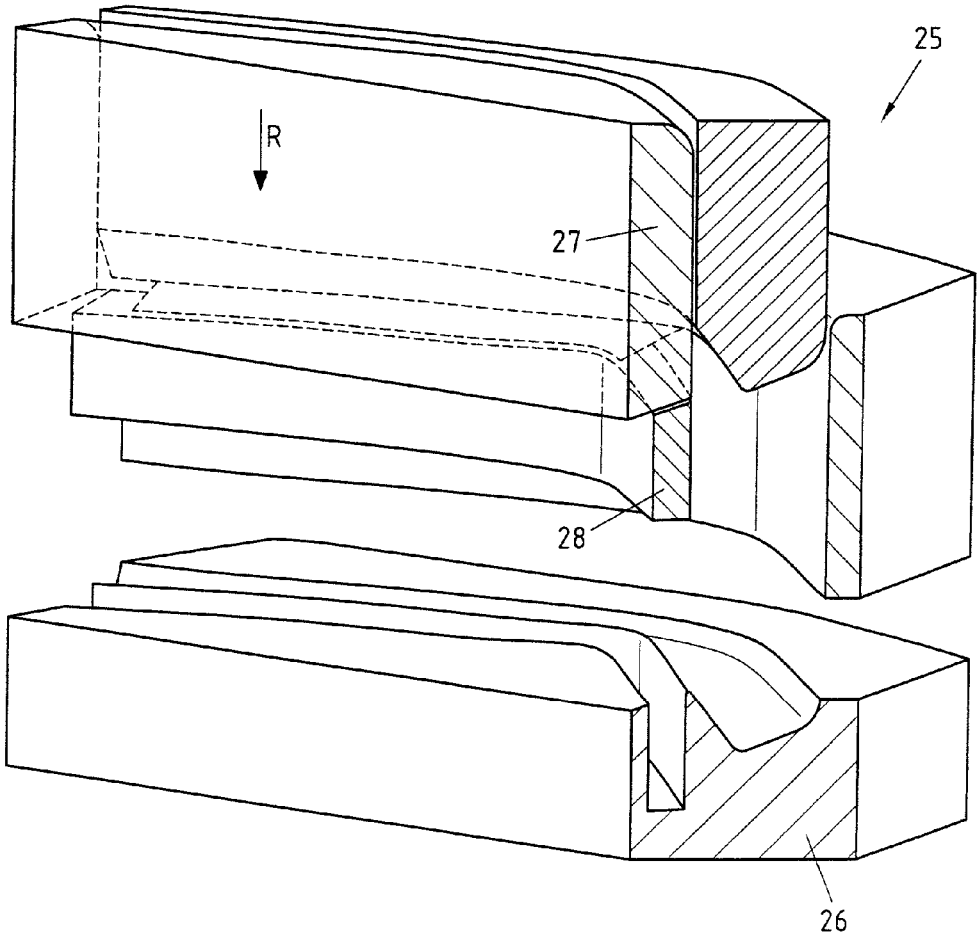
FIG. 8 shows the plate which is shown in FIG. 7 and which is arranged between a stamp and a first die.
Figure 9:
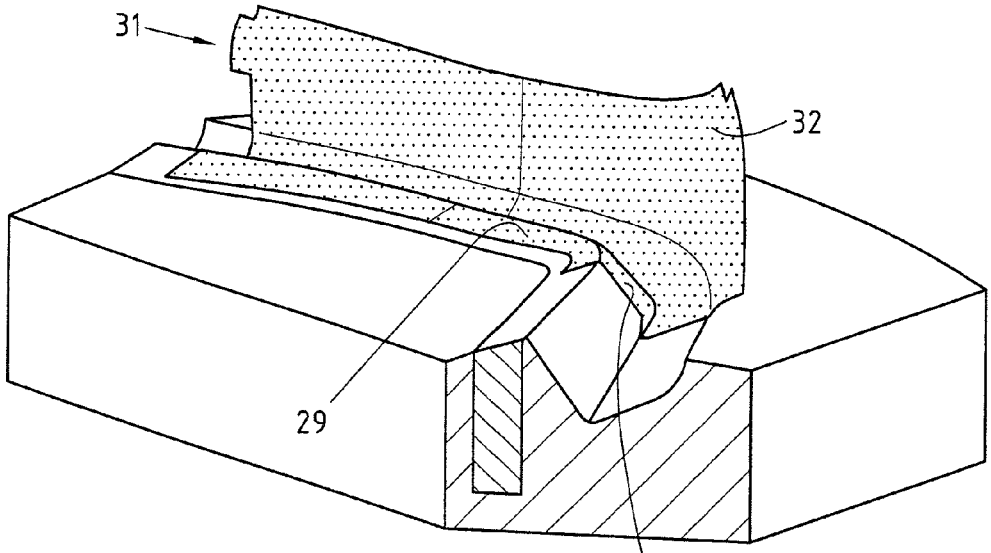
FIG. 9 shows the plate which is shown in FIG. 7 and which is preshaped to form a U-shaped profile-member.
Figure 10:
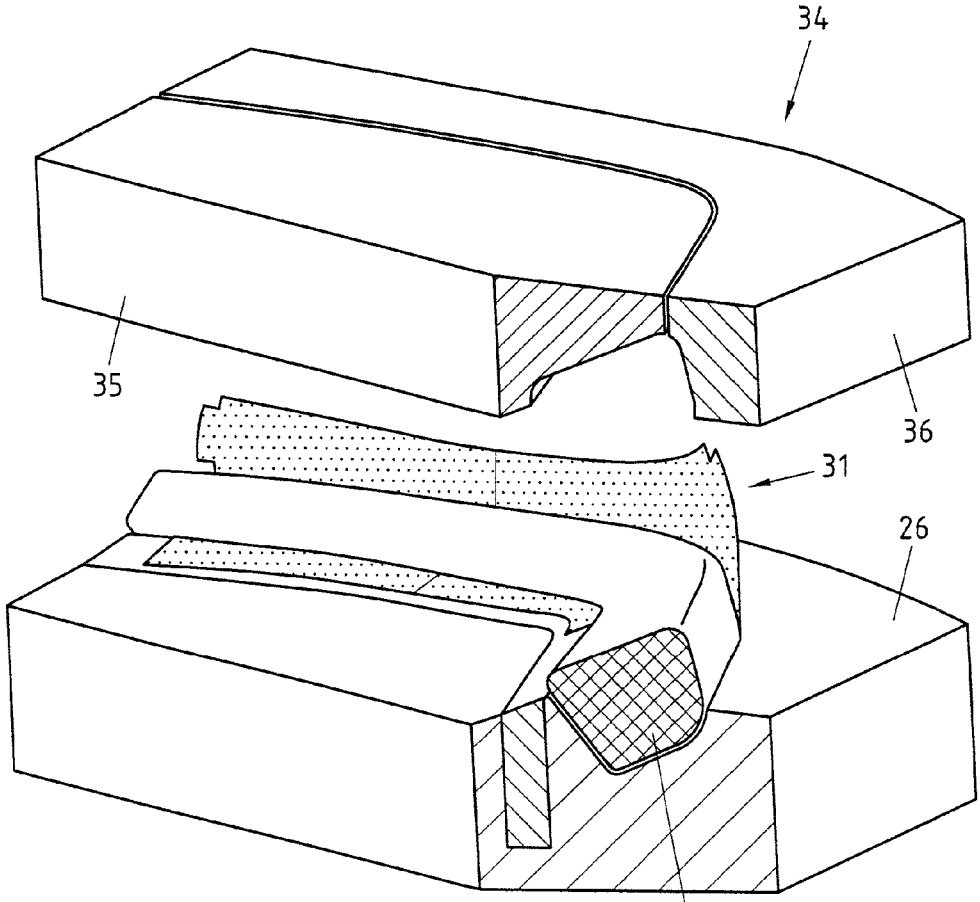
FIG. 10 shows a support core which is introduced into the U-shaped profile-member shown in FIG. 9 and a second die which is provided to shape the U-shaped profile-member to form an O-shaped profile-member.
Figure 11:
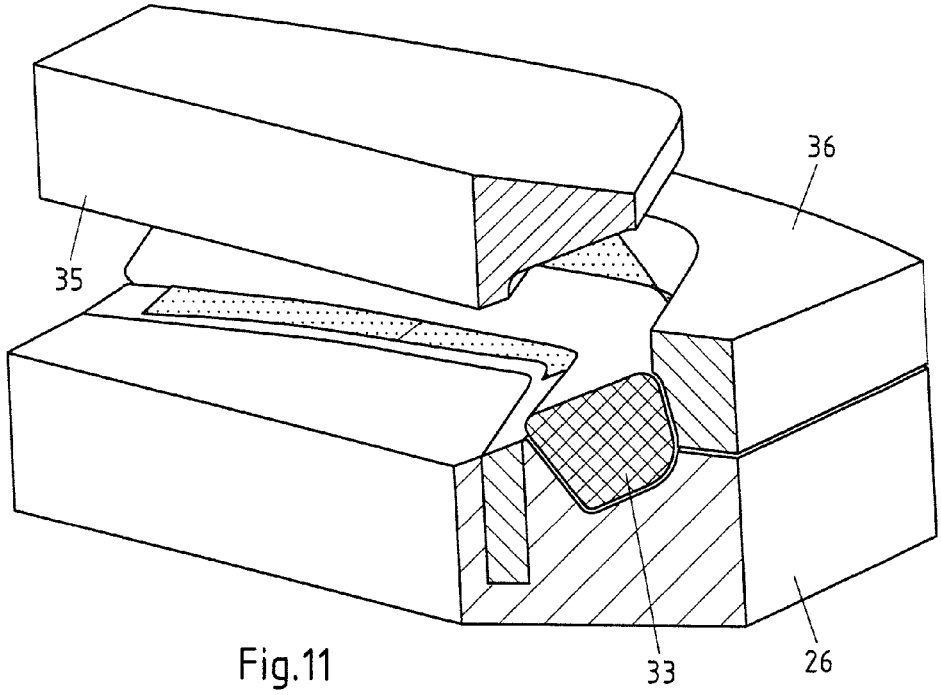
FIG. 11 shows the U-shaped profile-member which is shown in FIG. 9 and which is partially shaped to form an O-shaped profile-member.
Figure 12:
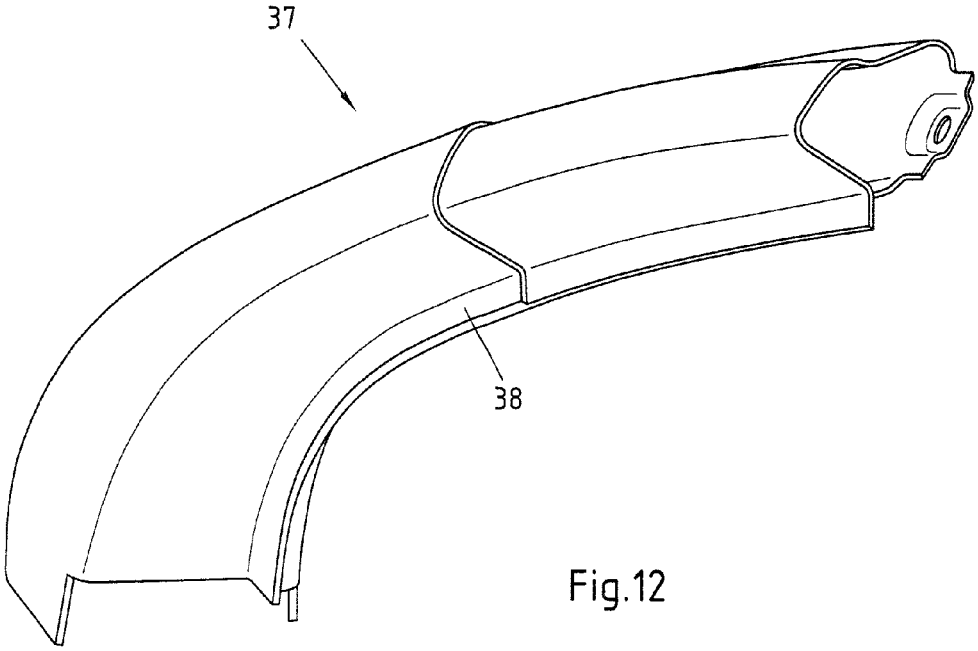
FIG. 12 shows the hollow profile-member produced from the plate shown in FIG. 7.

FIG. 7 illustrates another cut plate 24 for producing a hollow profile-member. This is arranged between a stamp 25 and a first die 26, as illustrated in FIG. 8. The stamp 25 has in this instance a part-stamp 27 which is positioned so as to protrude in the introduction direction R. A displaceable side wall 28 of the first die 26 is associated with the part-stamp 27 and is also positioned in a protruding manner. Between the part-stamp 27 and side wall 28, when the stamp 26 is introduced, the longitudinal flange member portion 29 is first formed in the first member 30 of the U-shaped profile-member 31 illustrated in FIG. 9. Subsequently, by introducing the stamp 25 further into the first die 26, the part-stamp 27 and the side wall 28 are displaced into an aligned position and the first member 30 and the second member 32 are formed. A structured support core 33 is then introduced into the U-shaped profile-member 31 which is arranged in the first die 26. The second die 34 comprises a first part-die 35 which is associated with the longitudinal flange member portion 29 and another part-die 36, FIG. 10. Firstly, the part-die 36 is moved in the direction of the first die 26 according to FIG. 11. The portion of the U-shaped profile-member facing away from the longitudinal flange member portion 29 is shaped. Subsequently, the part-die 35 is also lowered so that an O-shaped profile-member is formed. After the support core 33 is pulled and the edge joint is welded, the hollow profile-member 37 having a longitudinal flange 38 illustrated in FIG. 12 is produced. As can be seen in FIG. 12, the hollow profile-member 37 can be shaped in a very complex manner, for example, curved. Nonetheless, the method according to the invention enables the production of a hollow profile-member with a highly dimensionally accurate longitudinal flange 38.

Figure 13:
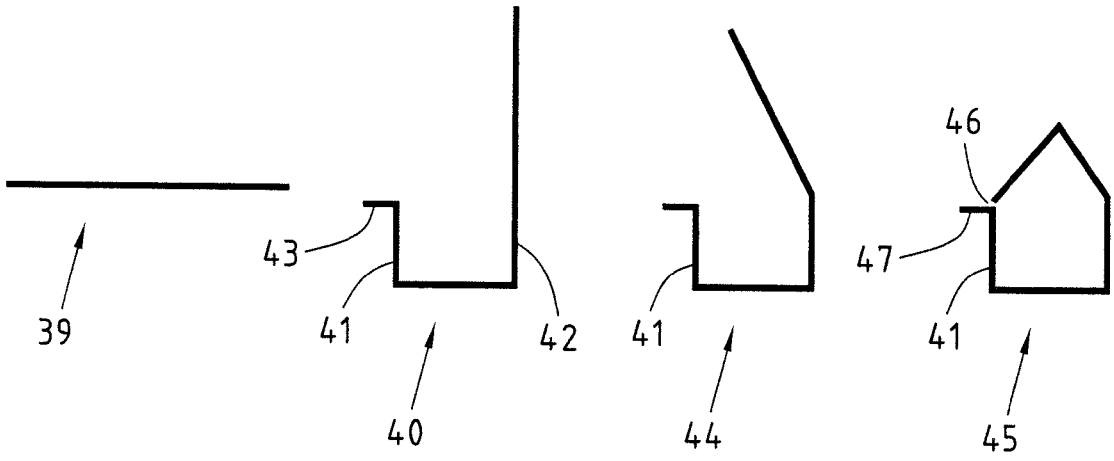
FIG. 13 is a schematic drawing to illustrate the production method shown in FIGS. 7 to 12.

In FIG. 13, the individual process steps of the last embodiment of a production of a hollow profile-member according to the invention using the individual cross-sectional shapes during the process steps are illustrated (illustrated without a support core). Firstly, the plate 39 is preshaped to form a U-shaped profile-member 40 having a first member 41 and a second member 42. In this instance, a longitudinal flange member portion 43 is formed in the first member 41. The U-shaped profile-member 40 is then shaped via an intermediate profile-member 44 to form an O-shaped profile-member 45 and the edge joint 46 is welded. The contour which surrounds the hollow space forms, together with the longitudinal flange 47, a shape which resembles the Figure "6".

The invention claimed is:

1. Method for producing hollow profile-members having a longitudinal flange, wherein a plate which is arranged between a stamp and a first die is preshaped by introducing the stamp into the first die to form an U-shaped profile-member having a first member and a second member, wherein the U-shaped profile-member is shaped with a second die to form an O-shaped profile-member having a longitudinal flange, and wherein the plate is preshaped to form the U-shaped profile-member such that a longitudinal flange member portion is shaped in at least the first member and the longitudinal flange member portion is constructed during the shaping of the U-shaped profile-member to form an O-shaped profile-member substantially in a shape-retaining manner to form a portion of the longitudinal flange, the method comprising the steps of:

shaping the longitudinal flange member portion at the beginning of the preshaping operation by means of a displaceable part-stamp of the stamp that is positioned so as to protrude in an introduction direction, and by means of a displaceable side wall of the first die that is positioned so as to protrude counter to the introduction direction;

moving the part-stamp and the side wall by the stamp being further introduced into the first die from the protruding position into an aligned position; and preshaping the plate to form the U-shaped profile-member.

2. Method according to claim 1, wherein a first die having at least a first displaceable side wall is used and, when the U-shaped profile-member is shaped to form the O-shaped profile-member having a longitudinal flange, the first side wall is displaced in the introduction direction by means of the second die.

3. Method according to claim 1, wherein there is used a second die which comprises a first part-die which is associated with the longitudinal flange member portion and at least one other part-die, and the U-shaped profile-member is shaped to form the O-shaped profile-member by the other part-die being lowered before the first part-die.

4. Method according to claim 1, wherein the U-shaped profile-member is constructed to form an O-shaped profile-member having a doubled longitudinal flange.

5. Method according to claim 1, wherein, before the U-shaped profile-member is shaped to form the O-shaped profile-member having a longitudinal flange, a support core, in particular a structured support core, is introduced into the U-shaped profile-member.

6. Method according to claim 5, wherein, by shaping the U-shaped profile-member to form the O-shaped profile-member having a longitudinal flange, an edge joint is formed and the O-shaped profile-member is closed in a materially engaging manner along the edge joint at least partially, in particular by means of laser welding.

7. Method according to claim 6, wherein the support core is pulled before or after the materially engaging closure.

8. Method according to claim 1, wherein, by shaping the U-shaped profile-member to form the O-shaped profile-member having a longitudinal flange, an edge joint is formed and the O-shaped profile-member is closed in a materially engaging manner along the edge joint at least partially, in particular by means of laser welding.

9. Method according to claim 1, wherein the hollow profile-member is produced from a monolithic plate, a Tailored Blank or a Patchwork Blank.

* * * * *